US005400038A

United States Patent [19]

Riza et al.

[11] Patent Number: 5,400,038

[45] Date of Patent: * Mar. 21, 1995

[54] HIGH SIGNAL TO NOISE RATIO OPTICAL SIGNAL PROCESSING SYSTEM

[75] Inventors: Nabeel A. Riza; Michael C. DeJule, both of Clifton Park, N.Y.

[73] Assignee: Martin Marietta Corporation, Syracuse, N.Y.

[ * ] Notice: The portion of the term of this patent subsequent to Dec. 28, 2010 has been disclaimed.

[21] Appl. No.: 950,554

[22] Filed: Sep. 25, 1992

Related U.S. Application Data

[63] Continuation-in-part of Ser. No. 900,877, Jun. 18, 1992, Pat. No. 5,274,385.

[51] Int. Cl.[6] ..... H01Q 3/22

[52] U.S. Cl. ..... 342/375; 342/368

[58] Field of Search ..... 342/368, 375; 359/629, 359/638, 639, 640; 250/227.12; 385/11, 36, 31, 32

[56] References Cited

U.S. PATENT DOCUMENTS 5,048,030 9/1991 Hiiro ..... 372/68
5,117,239 5/1992 Riza ..... 342/375
5,187,487 2/1993 Riza ..... 342/372
5,191,339 3/1993 Riza ..... 342/372
5,223,911 6/1993 Suchoski, Jr. et al. ..... 385/14
5,231,405 7/1993 Riza ..... 342/375
5,274,385 12/1993 Riza ..... 342/375

*Primary Examiner*—Gregory C. Issing
*Attorney, Agent, or Firm*—Paul Checkovich; Stephen A. Young

[57] ABSTRACT

An optical signal processing system includes a number of optical time delay units to generate differentially time-delayed optical signals. Each optical time delay unit includes at least an in put polarizing beam splitter (PBS) system having an input system Thompson prism and an output PBS system including an output Thompson prism. Each Thompson prism has a high extinction ratio and is positioned to act as a polarizing beam splitter, providing a high signal to noise ratio optical signal processing system. Selectively polarized light beams are deflected by the polarizing beam splitters onto predetermined paths that cause the respective light beams to be differentially time delayed dependent on the path that they follow through the optical signal processing system.

20 Claims, 3 Drawing Sheets

HIGH SIGNAL TO NOISE RATIO OPTICAL SIGNAL PROCESSING SYSTEM

RELATED APPLICATIONS

This application is a continuation in part of the application Nabeel Riza entitled "Optical Time Delay Units For Phased Array Antennas", now Ser. No. 07/900,877, filed Jun. 18, 1992, now U.S. Pat. No. 5,274,385, assigned to the assignee of the present invention.

BACKGROUND OF THE INVENTION

This invention relates generally to optical signal processing systems and more particularly to beamforming controls for phased array antennas in radar systems.

Phased array antenna systems employ a plurality of individual antenna elements or subarrays of antenna elements that are separately excited to cumulatively produce a transmitted electromagnetic wave that is highly directional. The radiated energy from each of the individual antenna elements or subarrays is of a different phase, respectively, so that an equiphase beamfront, or the cumulative wavefront of electromagnetic energy radiating from all of the antenna elements in the array, travels in a selected direction. The difference in phase or timing between the antenna activating signals determines the direction in which the cumulative beam from; all of the individual antenna elements is transmitted. Analysis of the phases of return beams of electromagnetic energy detected by the individual antennas in the array similarly allows determination of the direction from which a return beam arrives.

Beamforming, or the adjustment of the relative phase of the actuating signals for the individual antenna elements (or subarrays of antennas) can be accomplished by electronically shifting the phases of the actuating signals or by introducing a time delay in the different actuating signals that sequentially excite the antenna elements in order to generate the desired direction of beam transmission from the antenna.

Optical control systems are advantageously used to create selected time delays in actuating signals for phased array antenna systems. Such optically-generated time delays are not frequency dependent and thus can be readily applied to broadband phased array antenna systems. For example, optical signals can be processed to establish the selected time delays between individual signals to cause the desired sequential actuation of the transmitting antenna elements, and the optical signals can then be converted to electrical signals, such as by a high speed photodetector array.

Several architectures for optical time delay units have been proposed. For example, an optical beam forming system for a phased array antenna is disclosed in U.S. Pat. No. 5,117,239 of N. Riza entitled "Reversible Time Delay Beamforming Optical Architecture for Phased Array Antennas," which is assigned to the assignee of the present invention and incorporated herein by reference. These architectures generally depend on the use of linearly polarized light so that light beams of a predetermined polarization are directed through particular paths in the architecture to generate the differential time delay between a delayed and an undelayed signal. Thus, controlling the polarization of a light beam entering the architecture determines the path that the light beam follows, and the path determines the delay imparted to the light beam.

The optical control system disclosed in the above referenced patent includes a transmit/receive phased array beamformer for generating true-time-delays using optical free-space delay lines and two dimensional liquid crystal spatial light modulators for implementing the optical switching. Unlike conventional optical switching techniques, the liquid crystal-based optical switching elements can provide low insertion loss and low crosstalk level switching with relatively easily fabricated and low cost liquid crystals.

In these polarization based systems using arrays of nematic liquid crystals (NLCs) and polarizing beam splitters to generate the time delay used in controlling the antenna, several factors can cause system performance to be degraded. For example, cube beam splitters of the type typically have an extinction ratio of about 1000:1. That is, the intensity of the light passing from a given output port of the cube polarizing beam splitter (e.g., the p-polarized light port)is only one-thousand times the intensity of light of the opposite linear polarization (s-polarized light in this example) also passing from that output port. A device having extinction ratios of this magnitude provides an electrical signal to noise ratio of about 60 dB. Such a signal to noise ratio provides good optical signal processing system performance. In some applications, however, even better signal to noise ratios are advantageous, such as to enhance the detectability of long range targets or targets having a small radar cross section.

It is accordingly an object of this invention to provide a high performance optical signal processing system with optical time delay units having a signal to noise ratio better than that exhibited by systems using cube polarizing beam splitters.

It is a further object of this invention to provide a phased army radar system exhibiting improved detection of long range or small radar cross section targets.

SUMMARY OF THE INVENTION

An optical signal processing system includes an optical time delay unit (OTDU) in which incident light beams are directed along respective direct paths or delay paths depending on the polarization of the respective light beams. Each OTDU includes a delay assembly; an input polarizing beam splitter (PBS) system having, in accordance with this invention, at least one input system Thompson prism and means for optically coupling the input system Thompson prism to the delay assembly; and an output PBS system having at least one output system Thompson prism and means for coupling the delay system to the output system Thompson prism. The coupling means for the input PBS system is advantageously a second input system Thompson prism or, alternatively, an input PBS system mirror. Use of a second Thompson prism in the input PBS system provides additional filtering of the optical signals passing along the delay path in the optical time delay unit. In either case the coupling means is disposed to receive light beams deflected from the at least one input system Thompson prism and to deflect light into the delay assembly. Similarly, the coupling means for the output PBS system may be alternatively a second output system Thompson prism or an output PBS system mirror that is disposed to receive light beams passing from the delay assembly and to deflect them into the at least one output system Thompson prism.

Light beams pass into and out of the OTDU from adjoining components in the optical architecture of the signal processing system. Typically, adjoining components include an input pixel array and an output pixel array, each of the arrays having corresponding predetermined patterns of pixels, with the OTDU disposed to optically couple the input pixel array to the output pixel array so that a light beam passing through a selected one of the pixels in the input pixel army is directed to a corresponding pixel in the output pixel array along a direct path or a delay path dependent on the linear polarization of the light beam emerging from the input pixel array. The OTDU typically also includes an imaging system for directing light beams from each of the pixels in the input pixel array to a corresponding one of the pixels in the output pixel array.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE PREFERRED EMBODIMENT

Figure 1:
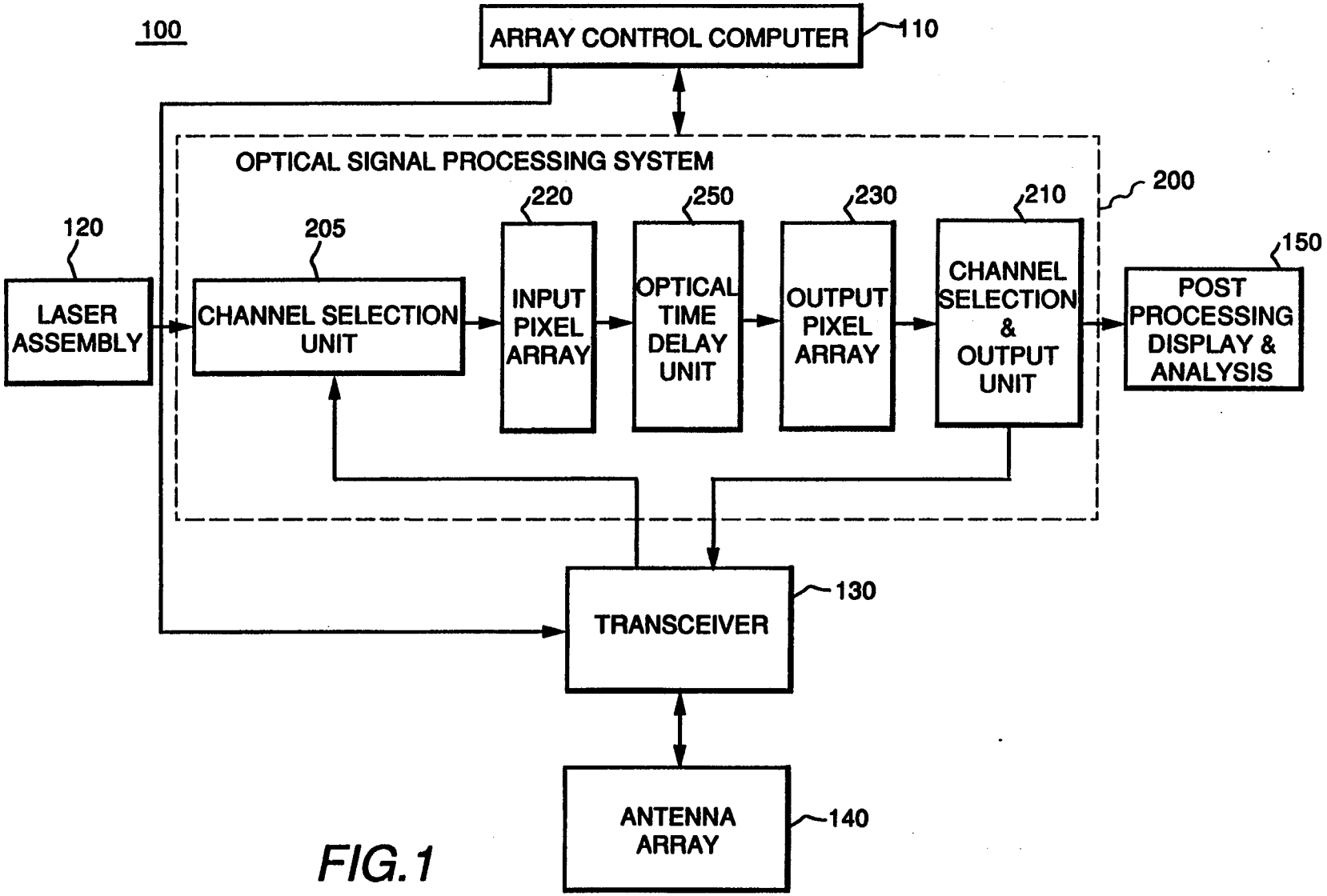
FIG. 1 is a block diagram of a phased-array antenna system comprising the present invention.

A phased-array antenna system 100 used as a radar or the like is illustrated in FIG. 1. Phased array antenna system 100 comprises an array control computer 110, a laser assembly 120, a transceiver 130 coupled to an antenna array 140, a post-processing display and analysis system 150, and an optical signal processing system 200. Array control computer 110 is coupled to the components listed above and generates signals to control and synchronize the operation of those components so that antenna array 140 can operate in either a transmit or a receive mode with desired beamforming characteristics.

In particular, laser source 120 is optically coupled so that linearly polarized light having a selected intensity and modulation passes into optical signal processing system 200. In the receive mode, return signals from antenna array 140 are also processed by signal processing system 200. Antenna system performance can be enhanced with a time-multiplexed arrangement described in copending application Ser. No. 07/826,501, filed Jan. 27, 1992 (RD-21,720), which is assigned to the assignee of the present invention and incorporated herein by reference. Light entering processing system 200 is passed through a channel selection unit 205 in which light beams are directed into a selected channel, typically by adjusting the polarization of the entering beams; and passing them through a polarizing beam splitter (not shown in FIG. 1) that directs them into respective channel paths dependent on the polarization of the light beams.

Light passing from channel selection unit 205 sequentially enters a cascade of optical signal processing components comprising an input pixel array 220, an optical time delay unit 250, and an output pixel array 230. In the cascade configuration, these components are arranged so that there is a series of a pixel array, an optical time delay unit, a pixel array, another optical time delay unit, another pixel array, etc., with this sequence of components repeating as necessary to provide the desired optical signal processing capabilities of the system. The polarization orientation of each light beam is individually selected as it passes through a respective pixel in input pixel array 220, and that polarization determines whether the light beam is directed into the direct path or the delay path in each optical delay unit 250.

The architecture of successive optical time delay units allows generation of differentially-time delayed optical signals for use in controlling the phased array antenna. For ease of discussion, only one group of these components is discussed herein (i.e., a sequence of one pixel array, an optical delay unit, the next successive pixel array); further, for ease of discussion, the respective pixel arrays are referred to as input and output arrays, although in the sequence of components the output pixel array of a first optical delay unit also serves as the input pixel array for the next subsequent optical delay unit. The final output pixel array in the cascade is optically coupled to a channel selection and transmit/-receive (T/R) output unit 210, from which the processed optical signals are directed to transceiver 130 in the transmit mode, or to post processing display and analysis system 150 in the receive mode.

Each input pixel array 220 typically comprises a spatial light modulator including nematic liquid crystals (NLCs) arranged in an array, but alternatively can comprise other types of optical processing devices, such as ferroelectric liquid crystals or the like. In a two channel device, each channel comprises independent processing capabilities for $A \times B$ collimated pairs of light beams so that at any given time in the operation of phased array antenna system 100, only one channel would be active (e.g., having light beams passed therethrough to be selectively delayed) while the inactive portions of the pixel arrays are being configured for the next processing evolution (e.g., to produce the optical signals to control the formation of the next beam to be transmitted/-received). Each input pixel array 220 has two independently-controllable sets of $A \times B$ pixels (one for each channel) so that the pixel array comprises a total of $2A \times B$ pixels that provide two independent channels for controlling $A \times B$ antenna elements or subarrays of antenna elements.

The pixels in each input pixel array 220 are arranged in a predetermined pattern. The pattern in which the pixels in each respective output array 230 (i.e., the next successive pixel array) are arranged corresponds to the respective input pixel array 220. To generate the optical control signal for each antenna element (or subassembly of elements), each respective light beam must pass from a respective pixel in input pixel array 220 through optical delay unit 250 and into a predetermined one of the pixel elements in output pixel array 230. In order for the respective light beams to pass from one predetermined pixel in the array to another predetermined pixel in the next pixel array in the cascade, it is important that light beams passing through optical delay unit 250 not be attenuated significantly nor undergo significant beam spreading. Further, in a high performance optical signal processing system having a high electrical signal to noise ratio, e.g. about 80 dB or better, it is important to provide good optical filtering of the light beams passing through the OTDU such that light beams substantially maintain the desired polarization and intensity.

Figure 2:
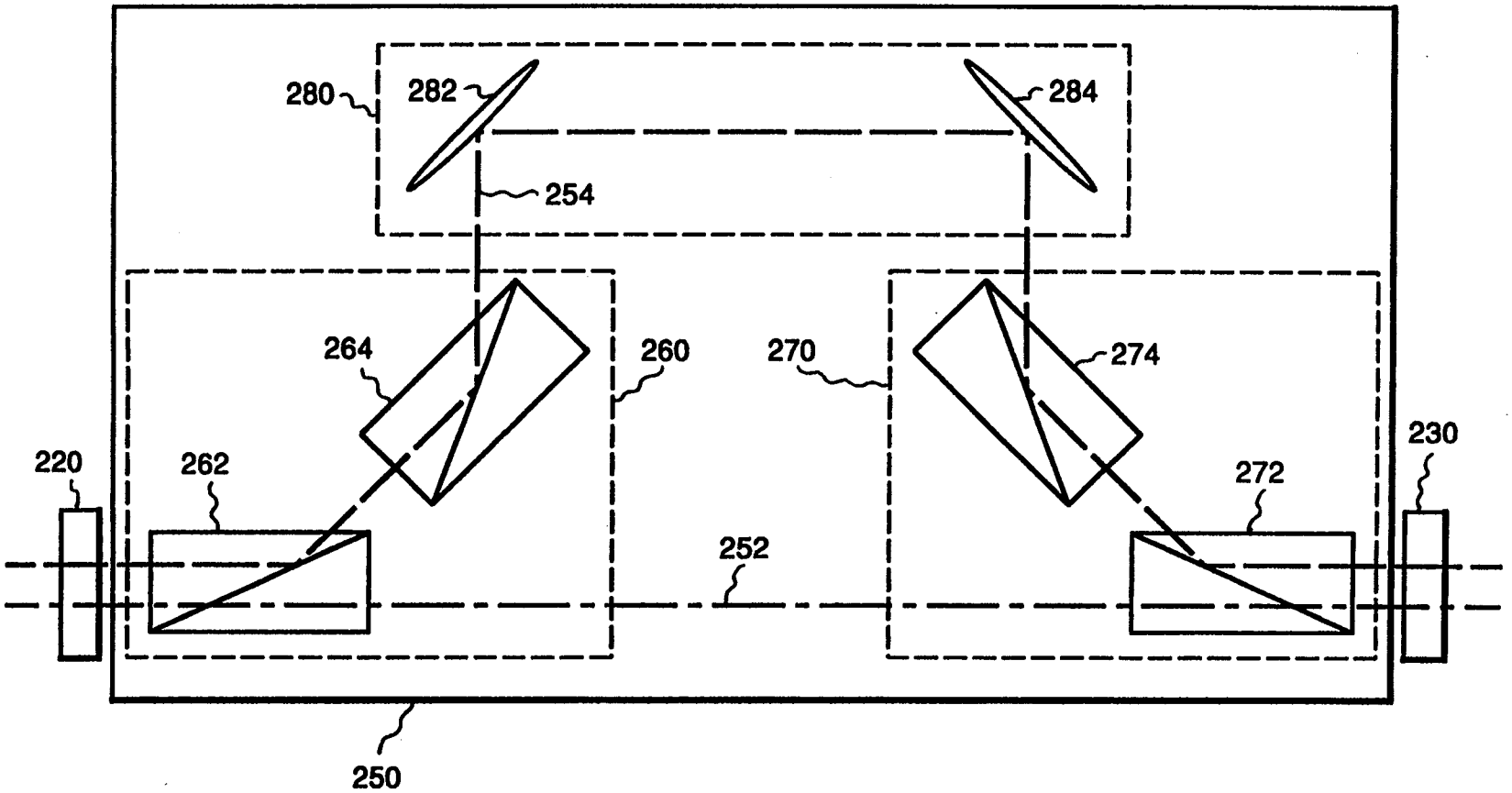
FIG. 2 is a schematic representation of a free-space optical delay unit in accordance with this invention.

As illustrated in FIG. 2, optical time delay unit 250 is optically coupled to input pixel array 220 and to output pixel array 230. In accordance with this invention, optical time delay unit 250 comprises an input PBS system 260, an output PBS system 270, and a delay assembly 280 (each of which is outlined in phantom in FIGS. 2 and 3). Input PBS system 260 is disposed to receive light beams passing from input pixel array 220. FIG. 2, by way of example and not limitation, illustrates a one channel device, with two representative light beams defining the boundaries of the plurality of light beams comprising the channel of light beams being processed. Individual light beams in the channel can traverse either a direct path 252 between input PBS system 260 and output PBS system 270 or a delay path 254 dependent on the polarization orientation of the light entering input PBS system 260. The paths shown are only illustrative for the purposes of describing the invention.

In accordance with this invention, input PBS system 260 comprises an input system Thompson prism 262. Each Thompson prism is an optical device which acts as a polarizing beam splitter, deflecting in different directions light that has a "p" (or horizontal) linear polarization and light that has an "s" (or vertical) linear polarization (that is, the s and the p polarized beams have ;mutual orthogonal linear polarizations). The Thompson prism provides a very high extinction ratio, on the order of 100,000:1, so that an excellent signal to noise ratio is achieved. For example, an optical signal processing system having Thompson prisms as beam-splitters would have a signal to noise ratio of about 100 dB, whereas an optical signal processing system using cube beam splitters (which have an extinction ratio of about 1000:1) typically exhibits a signal to noise ratio of about 60 dB; the 40 dB increase in signal to noise ratio through the use of Thompson prisms greatly enhances the sensitivity of the radar to targets having a small radar cross-section, such as targets at a long-range.

One characteristic of a Thompson prism is that the light is separated, according to its linear polarization, into one set of beams that passes through the prism substantially on a direct-pass-through axis and one set of beams on a deflection axis, which is oriented at an angle of about 45° with respect to the direct-pass-through axis. For the light beams to enter delay assembly 280, they typically must be deflected to a direction that enables the coupling of the input PBS system to the delay unit. For the commonly used delay assembly structure illustrated in FIG. 2, this coupling requires a further deflection of about 45° in the path of the light beams. This further deflection is advantageously achieved by a second input Thompson prism 264, which is disposed so that light beams passing along the deflection axis from input system Thompson prism 262 enter second input Thompson prism and are deflected by about 45° to enter delay assembly 280. For example, the light of a selected polarization that is deflected towards the delay path in input system Thompson prism 262 passes into second Thompson prism 264 along its respective direct-pass-through axis; light beams having this selected polarization are similarly deflected in second Thompson prism 264 onto its respective deflection axis, causing the further 45° change in the direction of propagation of the light beams having the selected polarization for deflection into delay assembly 280.

Similarly, output system 270 comprises an output system Thompson prism 272. Output system prism 272 is disposed so that light beams passing along direct path 252 enter the output system Thompson prism 272 along its direct-pass-through axis and light beams passing along delay path 254 enter it along its deflection axis, such that both the light beams passing along the direct path and light beams passing along the delay path exit output system Thompson prism aligned with the direct-pass-through axis. Output PBS system 270 advantageously comprises a second output Thompson prism 274, which is disposed so that light beams of the selected polarization passing along the delay path and exiting delay assembly 280 enter second output Thompson prism 274 and are deflected by about 45° onto a path to enter output system Thompson prism 272.

Delay assembly 280 typically comprises a mirror assembly having mirrors 282, 284 or similar apparatus for directing the light beams along a desired delay path so that the light emerging from input PBS system 260 and emanating along delay path 254 traverses a longer distance to reach output PBS system 270 than light emerging from input PBS system 260 and emanating along direct path 252 to output PBS system 270.

For example, as illustrated in FIG. 2, input PBS system 260 is disposed to receive light beams entering OTDU 250 from input pixel army 220. The beams incident on input system Thompson prism 262 enter along the direct-pass-through axis of the prism. Dependent on the linear polarization of the respective light beams, the respective beams having a particular polarization either continue to pass through input system Thompson prism along the direct-pass-through axis to direct path 252 towards output PBS system 270, or respective beams of a selected linear polarization are deflected by about 45° along the light deflection axis of the prism towards delay path 254. For example, OTDU 250 can be designed such that input system Thompson prism 262 causes p-polarized light to be deflected towards the delay path while s-polarized light continues towards the direct path. Thus, the rotation of the linear polarization of individual light beams in input pixel array 220 determines whether a given light beam will be directed onto the delay path or the direct path.

In operation, light beams emanating from laser assembly 120 (FIG. 1) or from another optical delay unit in the optical architecture of optical signal processing system 200 enter input pixel array 220 (FIG. 2). The operation of the present invention is equally applicable to a signal processing system having only one channel of light beams or a plurality of channels; thus the operation of only one channel is described here. In a signal processing system comprising multiple channels, other components in optical processing system 200 are used to switch between channel A and channel B to effect time multiplexed operation. Each light beam entering input pixel array 220 is of a known linear polarization (either by reason of emanating from a known laser source or passing from a preceding optical time delay unit in which the polarization of known selected light beams was changed to effect the time delay) and enters a respective pixel in the array. Typically each pixel comprises a nematic liquid crystal (for example, twisted or parallel-rub birefringent mode liquid crystals can be used). Dependent on the control signals applied to each respective pixel in the array, the linearly polarized light will pass through each pixel with its polarization either unchanged or shifted by 90° to the opposite linear polarization.

The light beams are then incident on input PBS system 260, and, dependent on the selected polarization for each light beam, are either passed directly through the input system Thompson prism 262 along direct path 252 or deflected towards delay path 254. For example, p-polarized light beams may pass directly through input system Thompson prism 262 while s-polarized light is deflected towards delay assembly 280. The light beams pass along direct path 252 into output system Thompson prism 272, where, due to the p-polarization, they pass directly through to output pixel army 230.

Light beams (s-polarized in accordance with the examples used herein) deflected by input system Thompson prism 26.2 are incident on second input Thompson prism 264 and further deflected to be coupled into delay assembly 280. Light in delay assembly 280 passes along delay path 254, being deflected by mirrors 282, 284 into output PBS system 270. Light beams of the selected polarization (s-polarized in accordance with this example) enter second output Thompson prism 274 in which, due to their polarization, they are deflected by 45° into output system Thompson prism 272, wherein they are deflected by a further 45° towards output pixel array 230. Light beams passing from output pixel array 230 either pass into the next subsequent optical time delay unit (not shown) or into channel selection and output unit 210 (FIG. 1).

Figure 3:
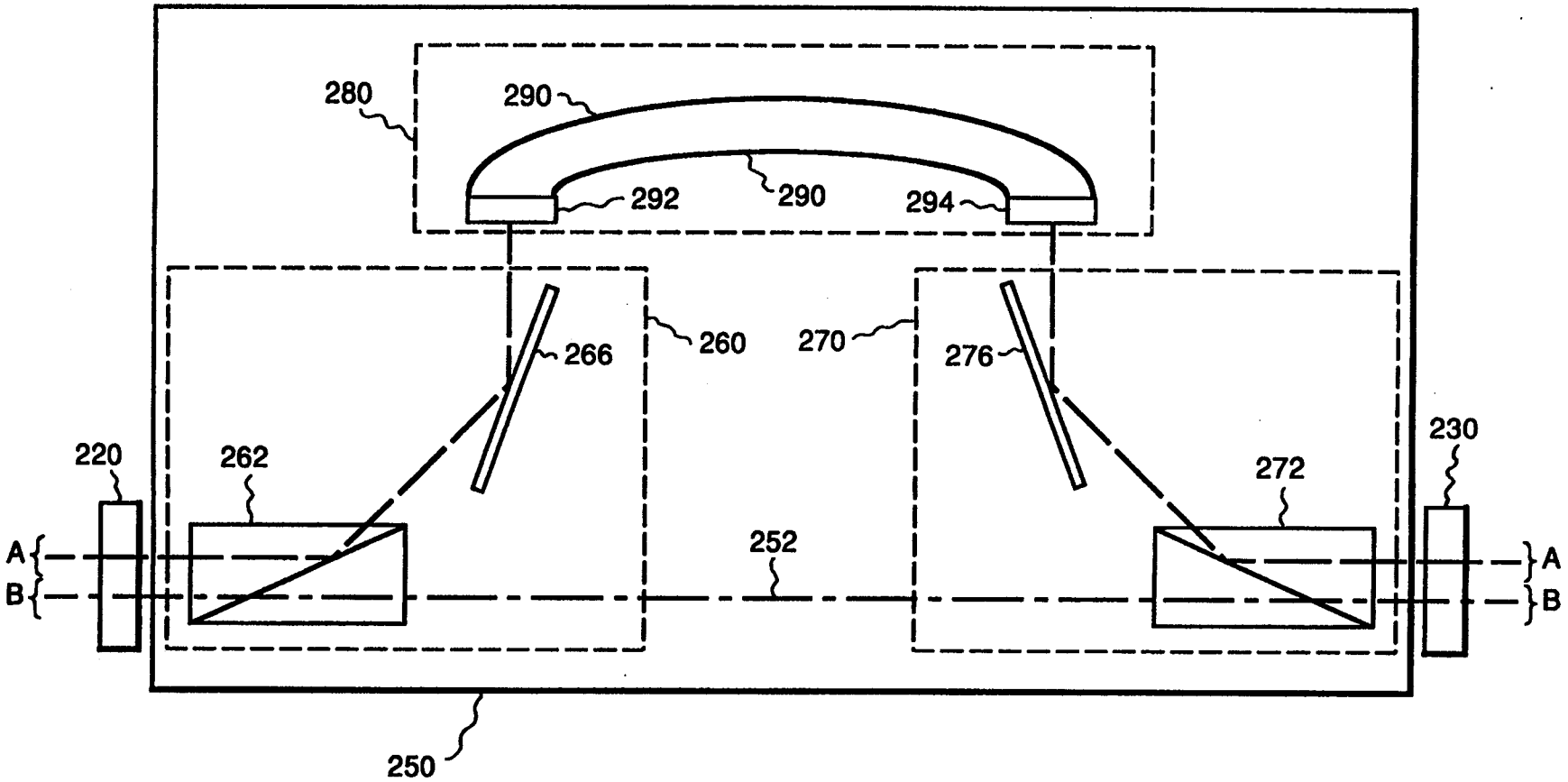
FIG. 3 is a schematic representation of an optical fiber-based optical delay unit in accordance with a further embodiment of this invention.

An alternative embodiment of the present invention is illustrated in FIG. 3. Optical time delay unit 250 is similar to the time delay unit described above with respect to FIG. 2 except as follows: input PBS system comprises a mirror 266 instead of second input Thompson prism 264; output PBS system comprises a mirror 276 instead of second output Thompson prism 274; and, delay assembly 280 comprises an optical fiber array 290 in the delay path to provide for longer time delays than are practical with free-space delay assemblies as described above with respect to FIGS. 2. Mirrors can be used in the input or output PBS systems independent of the use of optical fibers in the delay assembly, and similarly optical fiber delay assemblies can readily be used with the two-Thompson prism input and output PBS systems discussed above with respect to FIG. 2. Further, a two-channel system of light beams is illustrated in FIG. 3, with light beam "A" representing one of a plurality of light beams in one channel and light beam "B" representing one of a plurality of light beams in a second channel; the paths shown for light beams A and B are representative only, as light beams in each channel are selectively deflected along the delay path or direct path dependent on the polarization of the light beam emerging from input pixel array 220.

Mirror 266 is disposed in input PBS system 260 so that light beams deflected by input system Thompson prism 262 are incident on mirror 266 at an angle that results in the light beams being further deflected (e.g., by about 45°, as illustrated in FIG. 3) so that the beams are coupled into delay assembly 280. Similarly, mirror 276 is disposed in output PBS system 270 so that light beams exiting delay assembly 280 are incident on mirror 276 and deflected into output system Thompson prism 272.

Further, as illustrated in FIG. 3, delay assembly 280 comprises an optical fiber array 290, an input lenslet array 292 and an output lenslet array 294 disposed at respective ends of optical fiber array 290. Optical fiber array 290 comprises a plurality of polarization maintaining (PM) fibers having a selected length. The flexibility of PM fibers allows for relatively long lengths (which provide the ability to induce long differential time delays in the optical signals) to be coiled in relatively compact optical time delay units 250. Lenslet arrays 292 and 294 preferably comprise graded index (GRIN) or self-focussing (SELFOC) lenses. Alternatively, lenslet array sheets produced by holographic techniques or by binary optics can also be used. Respective ones of the light beams emanating from input PBS system are incident on selected lenses in lenslet array 292 and focussed into corresponding ones of the optical fibers in array 290. Light beams emerging from the fibers through lenslet array 294 are collimated.

As illustrated in FIG. 3, multiple channels of optical signals can be processed with the device of the present invention. Multiple channels of light beams are advantageously used for a variety of applications, such as time multiplexing as described in copending application Ser. No. 07/826,501 filed Jan. 27 1992, and assigned to the assignee of the present invention. The arrangements of this invention thus allow for a high performance optical signal processing system having high signal to noise ratios.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An optical time delay unit comprising:

a delay assembly;

an input polarizing beam splitter (PBS) system disposed to receive incident light beams and direct respective ones of said beams along a respective delay path or a respective direct path dependent on the polarization of the respective light beams; said input PBS system including at least one input system Thompson prism and means for optically coupling said input PBS system to said delay assembly; and an output PBS system disposed to receive light beams passing along respective ones of said delay paths and respective ones of said direct paths, said output PBS system including at least one output system Thompson prism and means for optically coupling said output PBS system to said delay assembly, said input PBS system and said output PBS system being optically coupled together such that light beams pass therebetween along respective ones of said direct paths.

2. The optical time delay unit of claim 1 wherein:

said means for optically coupling said input PBS system to said delay assembly comprises a second input Thompson prism disposed to receive light beams deflected by said at least one input Thompson prism towards said delay path such that the deflected light beams are further deflected by said second Thompson prism and coupled to said delay unit.

3. The optical time delay unit of claim 1 wherein:

said means for optically coupling said input PBS system to said delay assembly comprises an input PBS system mirror disposed to receive light beams deflected by said at least one input Thompson prism towards said delay path such that the deflected light beams are further deflected by said input PBS system mirror and coupled to said delay unit.

4. The optical time delay unit of claim 1 wherein:

said means for optically coupling said output PBS system to said delay assembly comprises a second output Thompson prism coupled to said delay assembly to receive light beams passing therefrom such that light beams having the polarization selected to pass along said delay path are deflected to pass into said at least one output Thompson prism.

5. The optical time delay unit of claim 2 wherein:

said means for optically coupling said output PBS system to said delay assembly comprises a second output Thompson prism coupled to said delay assembly to receive light beams passing therefrom such that light beams having the polarization selected to pass along said delay path are deflected to pass into said at least one output Thompson prism.

6. The optical time delay unit of claim 1 wherein:

said means for optically coupling said output PBS system to said delay assembly comprises an output PBS system mirror disposed to receive light beams passing along said delay path from said delay assembly such that the light beams are deflected by said output PBS system mirror into said at least one output Thompson prism.

7. The optical time delay unit of claim 2 wherein:

said means for optically coupling said output PBS system to said delay assembly comprises an output PBS system mirror disposed to receive light beams passing along said delay path from said delay assembly such that the light beams are deflected by said output PBS system mirror into said at least one output Thompson prism.

8. The optical delay unit of claim 2 wherein:

each of the Thompson prisms has a direct-pass-through axis and a light deflection axis having a light deflection angle with respect to said direct-pass-through axis of about 45°, and said second input Thompson prism is disposed such that the second input Thompson prism direct-pass-through axis is substantially aligned with the at least one input Thompson prism light deflection axis.

9. The optical delay unit of claim 4 wherein:

each of the Thompson prisms has a direct-pass-through axis and a light deflection axis having a light deflection angle with respect to said light entry/pass-through axis of about 45°, and said second output Thompson prism is disposed such that the second output Thompson prism deflection axis is substantially aligned with the at least one output Thompson prism light deflection axis.

10. The device of claim 1 wherein said delay assembly comprises a free space delay unit.

11. The device of claim 1 wherein said delay assembly comprises an optical fiber array, an input focussing lens array, and an output collimating lens army, said input focussing lens array being disposed to optically couple said input PBS system to said optical fiber array, and said output collimating lens array being disposed to optically couple said optical fiber array to said output PBS system.

12. An optical signal processing system comprising:

an input pixel array having a predetermined input array pattern;

an output pixel array having a predetermined output array pattern, said output army pattern corresponding to said input array pattern; and an optical time delay unit disposed to optically couple said input pixel array to said output pixel array so that light beams passing from predetermined ones of the pixels in said input pixel army will enter corresponding ones of the pixels in said output pixel array, whereby each of said light beams will pass along a respective delay path or a respective direct path in said optical time delay unit dependent on the polarization of the light beam;

said optical time delay unit comprising an input polarizing beam splitter (PBS) system having at least one input Thompson prism, an output PBS system having at least one output Thompson prism, and means for optically coupling said at least one input Thompson prism to said delay assembly.

13. The system of claim 12 wherein said means for optically coupling said at least one input Thompson prism to said delay assembly comprises a second input Thompson prism disposed to receive light beams deflected towards said delay path by said at least one input Thompson prism such that the deflected light beams having the selected polarization to pass along said delay path are further deflected by said second Thompson prism onto a path to pass into said delay assembly.

14. The system of claim 12 wherein:

said means for optically coupling said at least one input Thompson prism to said delay assembly comprises an input PBS system mirror disposed to receive light beams deflected towards said delay path by said at least one input Thompson prism such that light beams incident on said input PBS system mirror are further deflected onto a path to pass into said delay assembly.

15. The system of claim 12 wherein said means for optically coupling said delay assembly to said at least one output Thompson prism comprises a second output Thompson prism disposed such that light beams passing from said delay assembly are incident on said second output Thompson prism and light beams having the selected polarization for passing along said delay path are deflected into said at least one output Thompson prism.

16. The system of claim 13 wherein:

said means for optically coupling said output PBS system to said delay assembly comprises an output PBS system mirror disposed to receive light beams passing from said delay assembly such that the light beams are deflected by said output PBS system mirror into said at least one output Thompson prism.

17. The optical delay unit of claim 13 wherein:

each of the Thompson prisms has a direct-pass-through axis and a light deflection axis having a light deflection angle with respect to said direct-pass-through axis of about 45°, and said second input Thompson prism is disposed such that the second input Thompson prism direct-pass-through axis is substantially aligned with the at least one input Thompson prism light deflection axis.

18. The optical delay unit of claim 15 wherein:

each of the Thompson prisms has a direct-pass-through axis and a light deflection axis having a light deflection angle with respect to said direct-pass-through axis of about 45°, and said second output Thompson prism is disposed such that the second output Thompson prism light deflection axis is substantially aligned with the at least one output Thompson prism light deflection axis.

19. The system of claim 12 wherein said input pixel array and said output pixel array each comprises at least two independently controllable patterns of pixels arranged to pass at least a first and a second channel of light beams, each of said channels comprising a corresponding plurality of light beams.

20. In combination, the optical signal processing system of claim 12 and:

a plurality of antenna elements arranged in an array; and an optoelectronic transceiver array coupled to said optical signal processing system and said antenna army to convert optical signals passing to said antenna array into electrical signals and to convert electrical signals passing from said antenna array into optical signals;

said optical signal processing system being coupled to the antenna array and adapted to generate differentially time-delayed optical signals to control antenna array radiation patterns.

* * * * *